United States Patent [19]

Niino et al.

[11] Patent Number: 4,845,969

[45] Date of Patent: Jul. 11, 1989

[54] DIMENSION CONTROL DEVICE FOR CONTINUOUS ROLLING MACHINE

[75] Inventors: Shuhei Niino; Koichi Ishimura; Ken Okamoto; Koichi Ohba, all of Hyogo, Japan

[73] Assignee: Mitsubishi Denki Kabushiki Kaisha, Tokyo, Japan

[21] Appl. No.: 425,769

[22] Filed: Sep. 28, 1982

[30] Foreign Application Priority Data

Sep. 30, 1981 [JP] Japan ..... 56-157202
Sep. 30, 1981 [JP] Japan ..... 56-157203

[51] Int. Cl.[4] ..... B21B 37/10
[52] U.S. Cl. ..... 72/11; 72/13
[58] Field of Search ..... 72/11, 13, 9, 205, 19, 72/20

[56] References Cited

U.S. PATENT DOCUMENTS 2,281,083 4/1942 Stoltz ..... 72/13
3,540,248 11/1970 Hostetter et al. ..... 72/13
3,574,279 4/1971 Smith, Jr. ..... 72/11
3,628,358 12/1971 Fapiano ..... 72/19
3,802,236 4/1974 Smith, Jr. et al. ..... 72/11
4,137,742 2/1979 Tanifuji et al. ..... 72/19
4,292,825 10/1981 Morooka et al. ..... 72/19
4,357,819 11/1982 Elley ..... 72/221

FOREIGN PATENT DOCUMENTS 100811 8/1980 Japan ..... 72/205

*Primary Examiner*—Lowell A. Larson
*Attorney, Agent, or Firm*—Sughrue, Mion, Zinn, Macpeak & Seas

[57] ABSTRACT

A dimension control device for continuous rolling machine includes a correction mechanism for correcting a set tension of the rolling machine in accordance with temperature variations of a rolling material. With such a dimension control device, the width of the rolling material is controlled to a contstant at all times regardless of any variation in the temperature.

11 Claims, 9 Drawing Sheets

DIMENSION CONTROL DEVICE FOR CONTINUOUS ROLLING MACHINE

BACKGROUND OF THE INVENTION

This invention relates to a device for controlling the dimension of a rolling material in a continuous rolling machine.

In order to minimize dimensional variations, a conventional continuous rolling machine is provided with a tension control device as shown in FIG. 1.

In the figure, reference numeral 1 designates the an (i−1)th mill stand roll, 2 an i-th mill stand roll, 3 a rolling material, 4 an electric motor for driving each of the rolls, 5 power converters for supplying electric power to the motor, 6 speed control devices, 7 pilot generators for detecting the speeds of the motors, 8 adders for setting speeds for the driving motors 4 in each of the mill stands, 9 rolling pressure detectors, 10 a motor current detector, and 11 a tension control device which comprises a tension detecting device 11*a*, a comparator 11*b* for comparing a set tension value with an acutally measured value and a controlling calculator 11*c* for correcting the speed of the motor 4 according to a tension deviation value.

The operation of this device will now be described. When the tension control device 11 is not in operation, the driver motors 4 are so controlled by the speed controller 6 that their speeds are equal to set values $N_{i-1}$ and $N_i$. The tension control device 11 calculates a tension value $t_{i,i-1}$ between the (i−1)th mill stand and the i-th mill stand with the aid of the rolling pressure detection 9 and the motor current detector 10, to thereby correct the speed of the i-th mill stand roll 2 so that the values thus calculated become set values $T_{i,i-1}$. The operation of the tension control device 11 is as follows: When the front end of the rolling material 3 is gripped by the (i−1)th mill stand 1, the rolling pressure $P_{i-1,0}$ and motor current $I_{i-1,0}$ are measured, and a torque arm constant is calculated as:

$$C_{i-1} = \frac{I_{i-1,0}}{P_{i-1,0}} \tag{1}$$

When the front end of the rolling materal 3 is then gripped by the i-th mill stand 2, the rolling pressure $P_{i-1}$ and motor current $I_{i-1}$ are measured, and a current variation $\Delta I$ which is caused by the tension between the stands is calculated as:

$$\Delta I = I_{i-1} - C_{i-1} \times P_{i-1} \tag{2}$$

As the current variation $\Delta I$ due to the tension is proportional to the tension value $t_{i,i-1}$, the following calculation can be made:

$$t_{i,i-1} = a_{i-1} \times \Delta I_{i-1} \tag{3}$$

The above described calculation of expressions (1), (2) and (3) are made by the tension control device 11*a*. The difference between the actually measured tension values $t_{i,i-1}$ and the set tension values $T_{i,i-1}$ is calculated by the comparator 11*b*, and the amount of speed correction for the i-th mill stand 2 is calculated by the controlling calculator 11*c* so that the difference signal becomes zero, and is then applied to the adder 8. The rolling material 3 can be maintained under a constant tension as described above.

With the conventional tension control device for the continuous rolling machine constructed as described above, the tension can be constantly maintained at the set value, but the device suffers from a difficulty in that dimensional change due to temperature variations of the rolling material 3 cannot be eliminated. The reason for this is that, when the rolling material 3 is rolled by a hole roll, the width is changed by the tension and is simultaneously changed by the variation in deformation resistance attributable to the variation in temperature of the rolling material.

The foregoing will be described with reference to FIGS. 2 through 5 for a rolling machine having a hole roll as an example. FIG. 2(*a*) and FIG. 2(*b*) show sections of a rolling material between mill stands in a continuous rolling machine. More specifically, FIG. 2(*a*) shows a section between the (i−1)th mill stand and the i-th mill stand, and FIG. 2(*b*) shows a section after the i-th mill stand. FIG. 3 shows sections of the rolls 2 and the rolling material 3 at the i-th mill stand. The width B of the rolling material 3 is changed by the tension (compressive force) between the mill stands because it is not regulated by the rolling rolls 2.

FIG. 4 indicates the relationship between tensions (compressive forces) between the stands and width variations $\Delta B$. As is clear from FIG. 4, as the tension increases, the width variation is increased negatively, and as the compressive force increases, the width variation $\Delta B$ is increased positively. As the deformation resistance of the rolling material 3 is decreased, the relation of the width variation $\Delta B$ to the tension (compressive force) is increased. FIG. 5 shows the relationship between the temperature and the deformation resistance in the rolling material. As the rolling material temperature increases, the deformation resistance is decreased.

Because of the relationships described above, as the rolling material temperature changes with the tension maintained at a constant value, the deformation resistance is changed also. As the temperature is decreased as in the case of a skid mark, the deformation resistance is increased, and the width of the rolling material 3 is changed from the point A to the point B indicated in FIG. 4.

SUMMARY OF THE INVENTION

The present invention has been accomplished in order to eliminate the foregoing drawback accompanying the prior art system, and an object of the present invention is to eliminate variations in width due to variations in temperature by employing a method in which the temperature of a rolling material is detected and the tension is controlled according to the temperature thus detected.

Another object of the invention is to eliminate variations in width due to variations in temperature by detecting the change in the deformation resistance due to a temperature variation or the like in the rolling material based on the rolling pressure, and controlling the width dimension of the rolling material by correcting the set tension value based on the rolling pressure and the tension (compressive force) in the rolling material.

DESCRIPTION OF THE PREFERRED EMBODIMENTS

Figure 1:
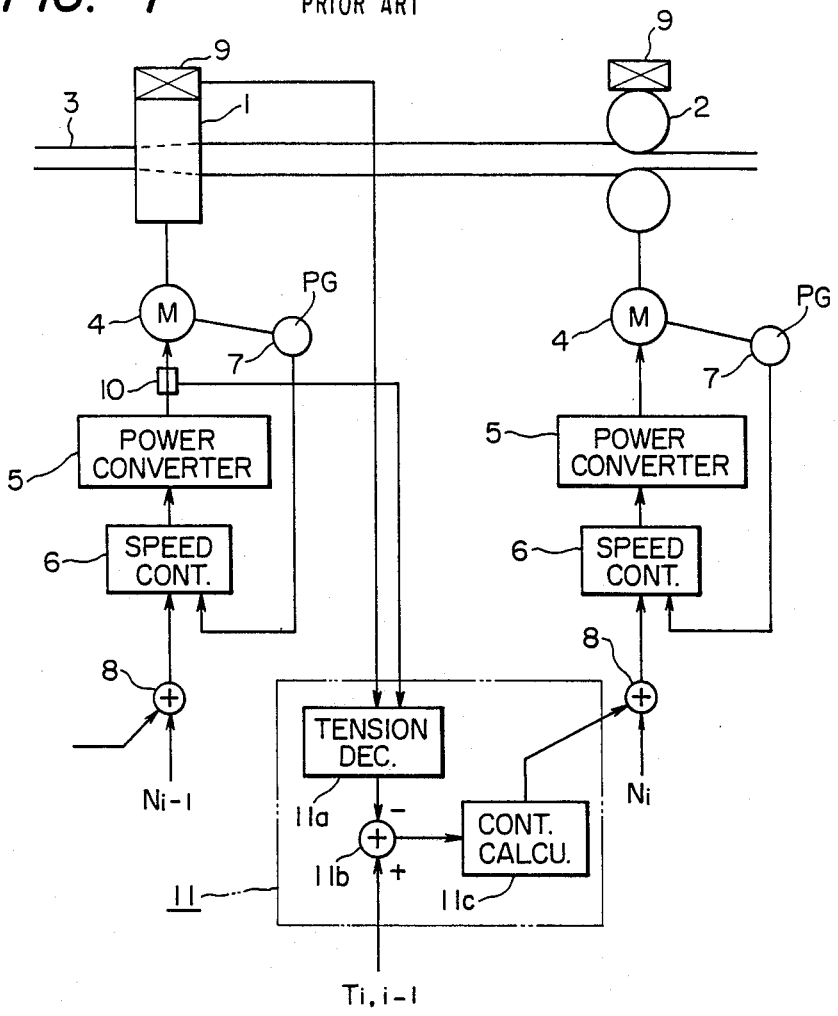
FIG. 1 PRIOR ART
FIG. 1 is a block diagram showing a conventional tension control device for a continuous rolling machine.
Figure 2A:
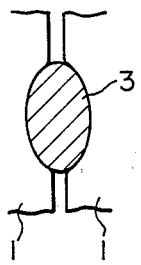
FIGS. 2(*a*) and 2(*b*) are cross-sectional views illustrating the cross-sections of a rolling material between mill stands.
Figure 2B:
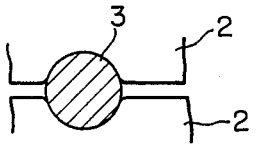
Figure 3:
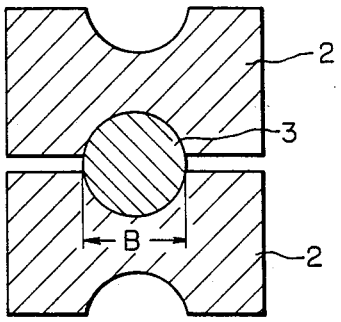
FIG. 3 is a cross-sectional view illustrating the sections of a roll and a rolling material at the mill stand.
Figure 4:
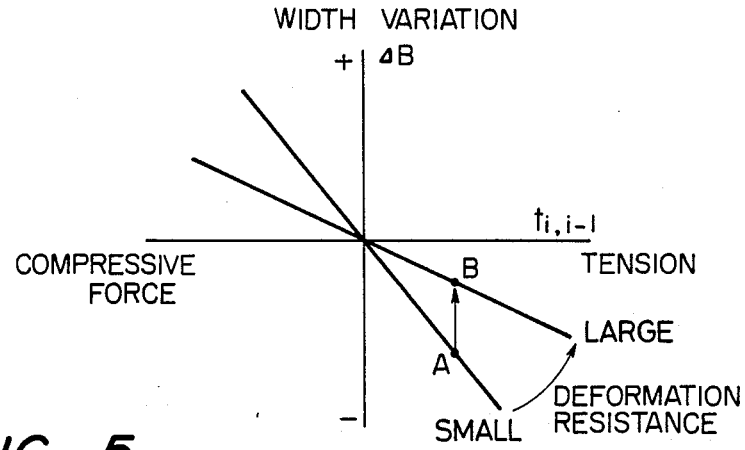
FIG. 4 is a characteristic diagram showing the relation between the tension and rolling material width variations.
Figure 6:
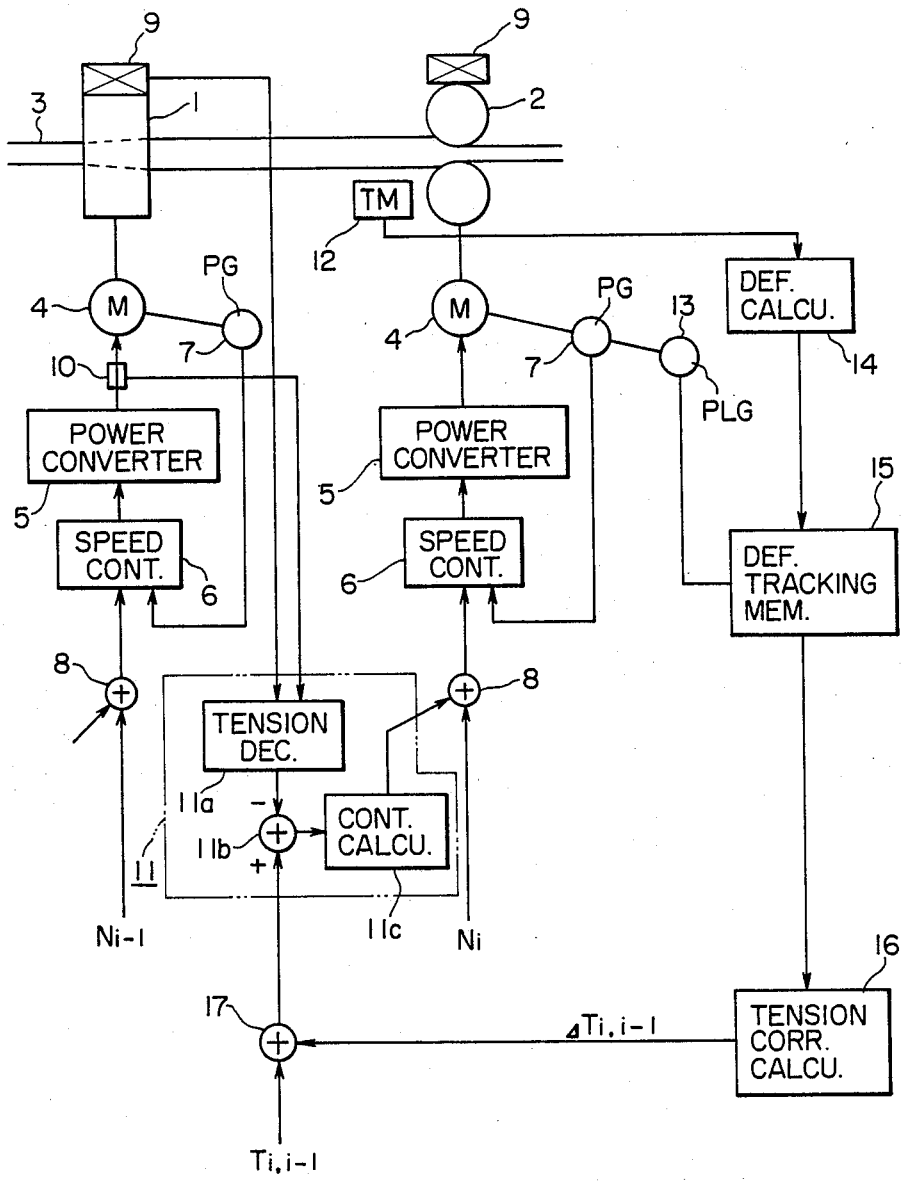
FIG. 6 is a block diagram showing a first embodiment of a dimensional control device according to the present invention.

A first embodiment of a dimension control device according to the present invention will now be described with reference to the accompanying drawings. In FIG. 6, which shows the first embodiment, the same components as those shown in FIG. 1 bear the same reference numerals or symbols, and reference numeral 12 designates a thermometer for measuring the temperature of the rolling material, 13 a roll revolution detecting device such as a pulse generator, 14 a deformation resistance calculator, 15 a deformation resistance tracking memory, 16 a tension correction calculator and 17 a tension adder.

The operation of the first embodiment thus constructed will now be described.

Figure 5:
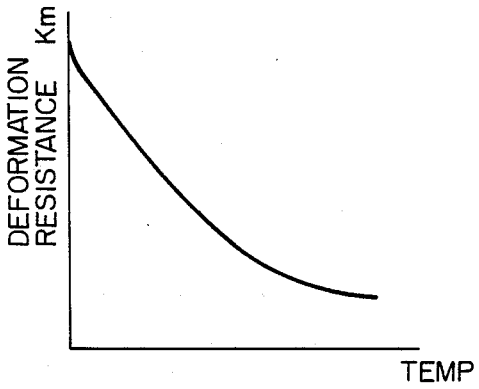
FIG. 5 is a characteristic diagram showing the relation between rolling material temperature and deformation resistance.

The temperature TEMP of the rolling material is measured with the thermometer 12. The deformation resistance calculator 14 calculates the deformation resistance Km using expression (4) according to the function indicated in FIG. 5:

$$Km = f(TEMP) \quad (4)$$

There is a certain distance between the position of the thermometer 12 and the i-th stand roll depending on the control conditions at the installation. Therefore, in order to track the conveyance of the rolling material 3 over the distance, the calculated deformation resistance Km is stored using the roll revolution detecting device 13, in the deformation resistance tracking memory 15. Accordingly, a plurality of deformation resistances Km of the rolling material along the distance between the position of the thermometer 12 and the position immediately below the i-th stand roll are stored in the memory 15. According to the following expression (5), a tension correction value $\Delta T_{i,i-1}$ is calculated using the content Km of the memory of the position immediately below the i-th stand roll and the inter-stand tension set value $T_{i,i-1}$:

$$\Delta T_{i,i-1} = g(T_{i,i-1} Km) \quad (5)$$

The correction value thus calculated is added to the tension set value $T_{i,i-1}$ in the tension adder 17, and the result of addition is applied, as an instruction value, to the tension control device 11.

Figure 7:
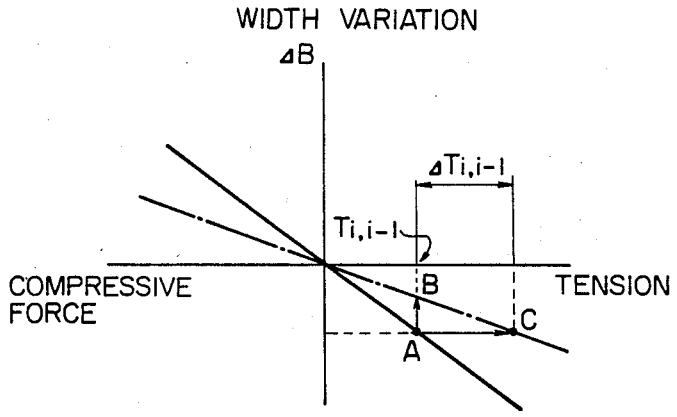
FIG. 7 is a diagram showing the relationship between the tension and width variations of the rolling material.

This operation will be described with reference to FIG. 7. In FIG. 7, the solid line indicates the relation between tension and width variation with a reference temperature, and the one-dot chain line indicates the relation between tension and width variation at a measurement temperature. In the case of the reference temperature with the set tension $T_{i,i-1}$, the width variation is at the point A on the solid line.

When the measurement temperature is lower than the reference temperature, with the set tension value $T_{i,i-1}$, the width variation $\Delta B$ is shifted to the point B on the one-dot chain line, so that width variation is caused. However, by increasing the tension by adding the tension correction value $\Delta T_{i,i-1}$ to the set tension value $T_{i,i-1}$ in the tension addder 17, the width variation $\Delta B$ is moved to the point C on the one-dot chain line, so that no width change is caused.

In the above described embodiment, the tension correction value is input to the tension control device according to the rolling material temperature and tension value. However, since the invention is intended to correct the inter-stand tension according to temperature variation of the rolling material, the stand speed may be corrected directly. Examples of this method will be described with reference to FIGS. 8 and 9.

Figure 8:
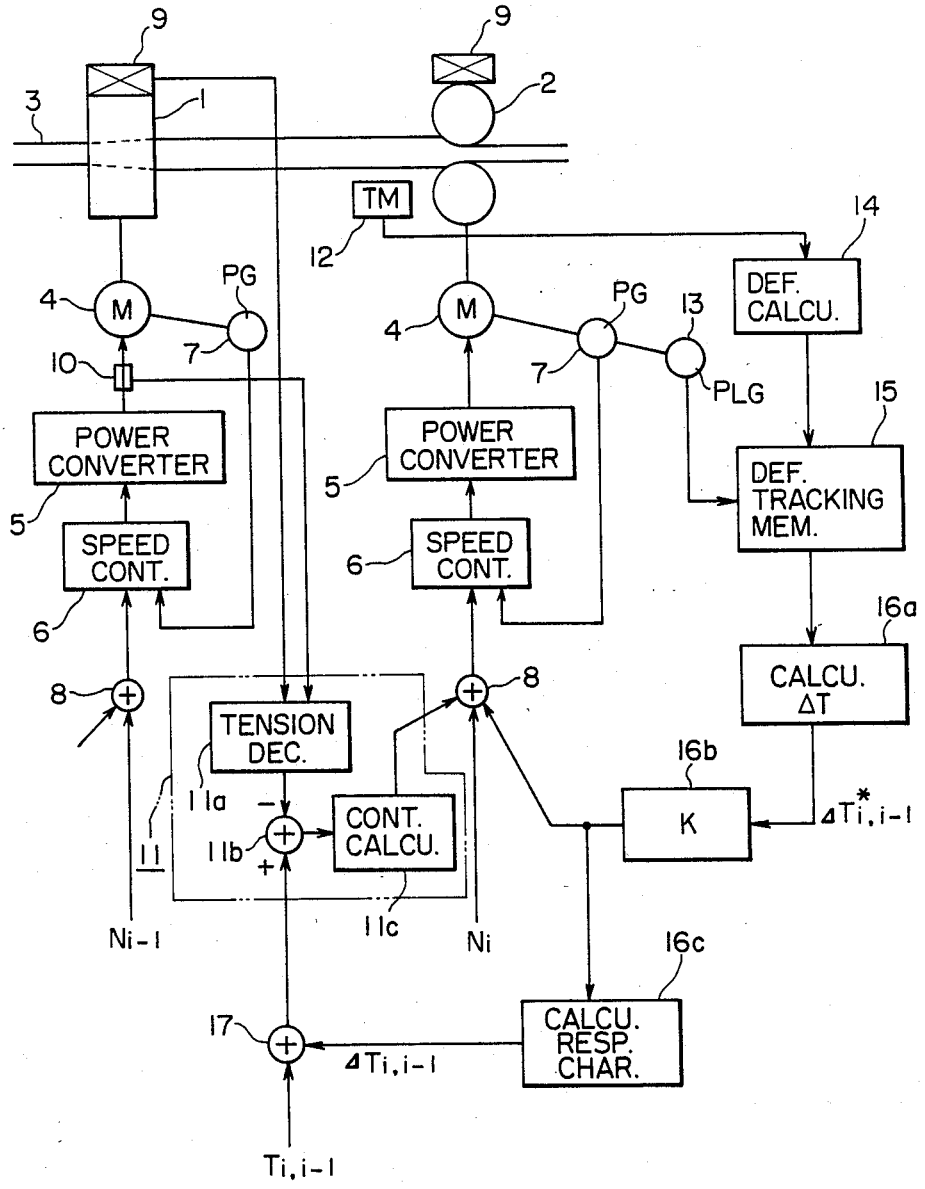
FIGS. 8 and 9 are block diagrams each showing a further embodiment of the present invention.

In the example of FIG. 8, the roll speed is corrected according to an inter-stand tension correction value, and the set tension value is corrected according to the response characteristic of roll speed and tension variation. In FIG. 8, reference character 16*a* designates a calculator for calculating an inter-stand tension correction value from the deformation resistance 16*b* a constant for converting an inter-stand tension correction value into a roll speed, and 16*c* a calculator which is in agreement with the response characteristic of the roll speed variation and tension variation with respect to an inter-stand tension correction value instruction. As the roll speed is changed by the output of the constant 16*b*, the rolling material tension is changed. If the set tension is unchanged, the tension is again made constant by the tension control calculator 11. In order to prevent this, the calculator 16*c* is provided.

Figure 9:
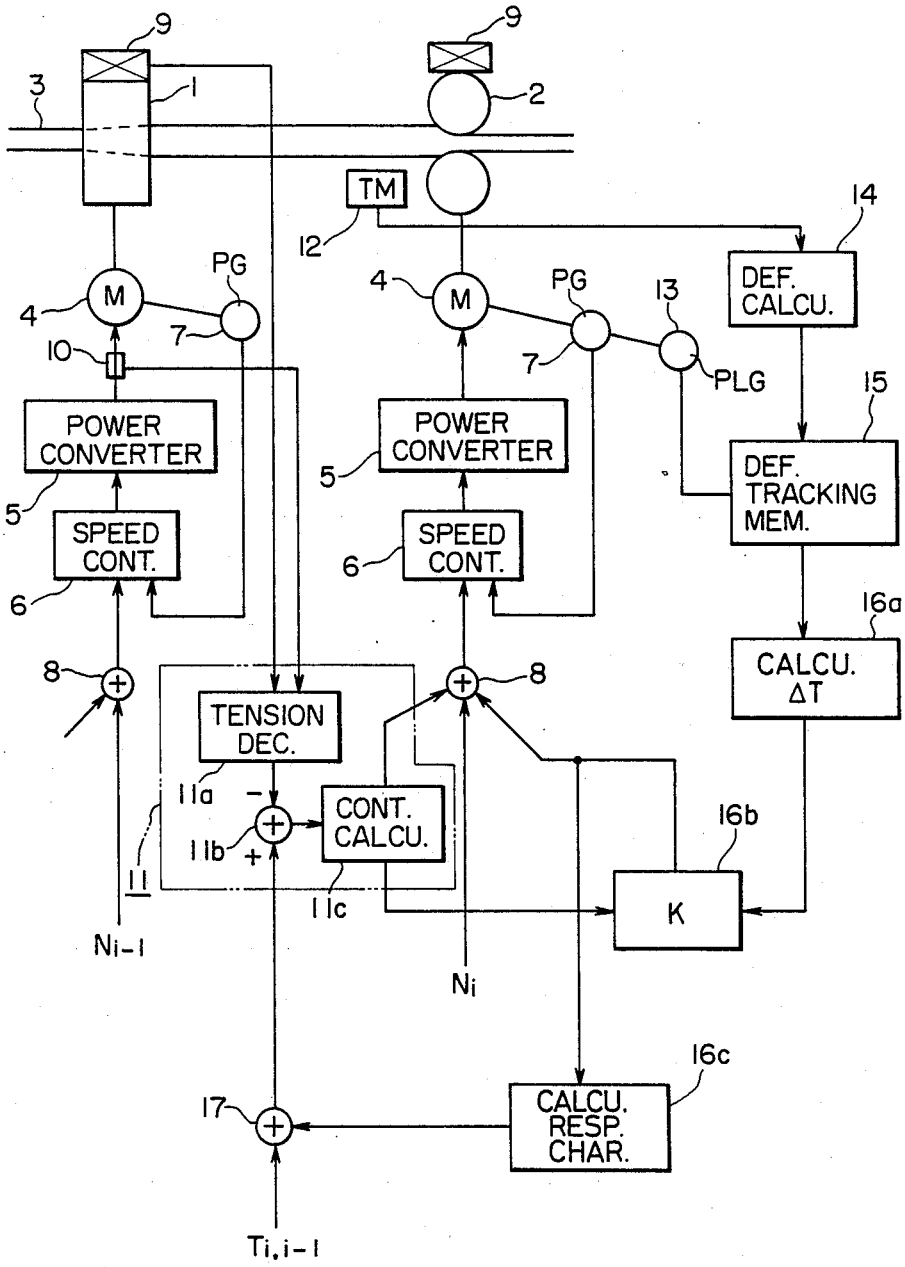

The example shown in FIG. 9 can be obtained by modifying the example in FIG. 8 in such a manner that the conversion of the inter-stand tension correction value into the roll speed correction value is carried out by the use the tension roll speed gain, which is actually measured by the tension control calculator 11*c*.

In the above described embodiment, the tension control device 11 performs control according to the rolling pressure and the motor current, however, the invention is not limited thereto. Furthermore, in the above described embodiments, the output of the tension control device 11 corrects the speed of the downstream stand, however, it may correct the speed of the upstream stand as well. In addition, a deformation resistance tracking memory is employed, however, in the case where the distance between the thermometer 12 and the i-th stand is short or the rolling speed is high, the roll revolution detecting device 13 and the deformation resistance tracking memory 15 may be eliminated. Furthermore, in the above described embodiments, after the temperature is converted into the deformation resistance by the deformation resistance calculator 14, the tension correction value is calculated. However, the same effect can be obtained by modifying the embodiments in such a manner that the tension correction value is calculated directly from the temperature and the tension value.

Figure 10:
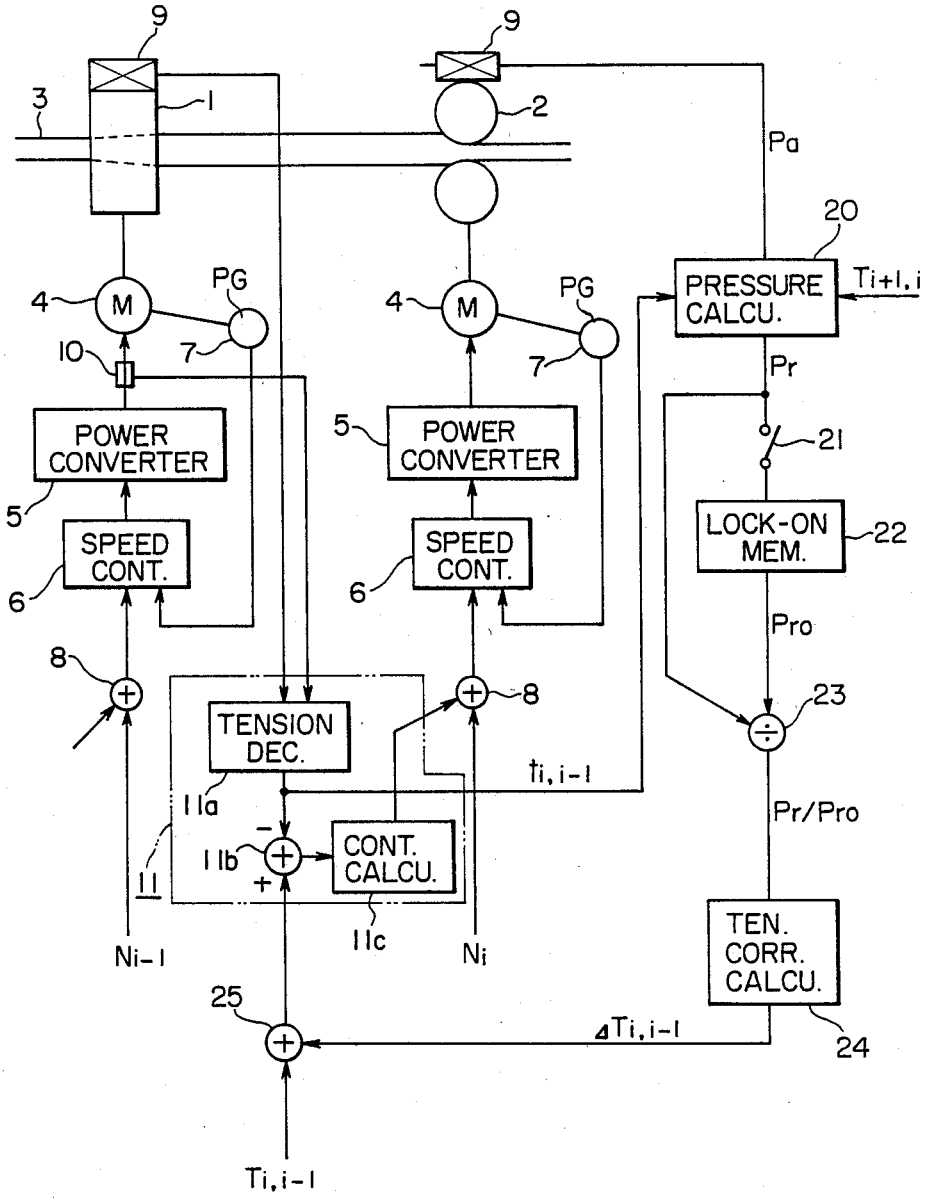
FIG. 10 is a block diagram showing another embodiment of the invention.

Another embodiment of the present invention will be described referring to FIG. 10. In FIG. 10, reference numerals 1 to 11 designate the same components as those in FIG. 1. In FIG. 10, reference numeral 20 denotes a non-tension rolling pressure calculator that calculates a rolling pressure Pr under no tension based on an actually measured rolling pressure Pa and inter-stand tension value $T_{i,i-1}$; 21, a lock-on switch for storing the rolling pressure Pr under no tension when the front end of the material is gripped by the i-th stand 2; 22, a memory for storing the rolling pressure Pro under lock-on, 23 a divider for determining the ratio between the rolling pressure Pr under no tension and the rolling pressure Pro under the lock-on; 24, a tension correction calculator and 25, a tension adder.

The operation of this embodiment of the invention thus constituted will now be described.

Figure 11:
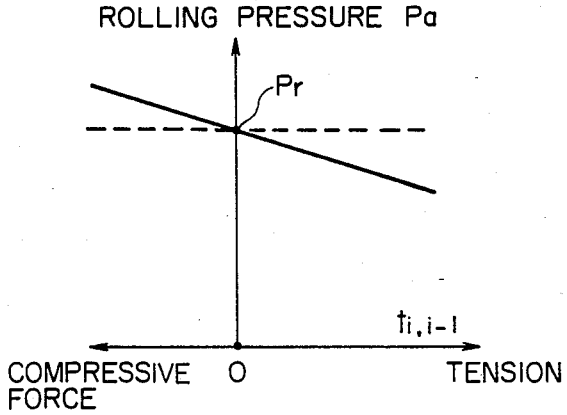
FIG. 11 is a characteristic diagram showing the relationship between the rolling pressure and the tension.

In this invention, changes in the deformation resistance due to changes in the temperature or the like are measured based on the rolling pressure. When no tension is present between the stands, the rolling pressure under no tension is in proportion to the deformation resistance but the rolling pressure Pa measured by rolling pressure detector 9 is affected by the tension. FIG. 11 shows the relationship between tension and the rolling pressure, in which the solid line represents the effect of the backward tension on the rolling pressure, and the broken line represents the effect of the tension. The rolling pressure Pr under no forward tension is calculated from the relationship in FIG. 11 by the calculator 20 following equation (6):

$$Pr = Pa + \frac{\partial p}{\partial tf} \cdot t_{i+1,i} + \frac{\partial p}{\partial tb} \cdot t_{i,i-1} \quad (6)$$

where $\frac{\partial p}{\partial tf}$:

effect coefficient of the rolling pressure on the forward tension, $\frac{\partial p}{\partial tb}$:

effect coefficient of the rolling pressure on the backward tension, $t_{i+1,i}$: forward tension, and $t_{i,i-1}$: backward tension When the front end of the rolling material 3 is gripped by the i-th stand 2, the lock-on switch 21 is closed a predetermined time after the transient states upon gripping have been settled to store the rolling pressure Pro at the front end of the rolling material in the lock-on memory 22.

Then, the ratio Pr/Pro between the rolling pressure Pr under no tension and the rolling pressure Pro under lock-on is determined by the divider 23. Since the rolling pressure Pr under no tension is in proportion to the deformation resistance of the rolling material 3, the ratio Pr/Pro represents the ratio of the deformation resistance at the measuring point relative to the front end of the rolling material.

Then, tension correction values $\Delta T_{i,i-1}$ are calculated in the tension correction calculator 24 according to the following equation (7):

$$\Delta T_{i,i-1} = g(T_{i,i-1}, Pr/Pro) \quad (7)$$

The correction values are added to the set tension values $T_{i,i-1}$ in the adder 25 and the result is applied as an instruction value to the tension control device 11.

This operation will be explained referring to FIG. 7. Assuming the rolling pressure near the front end of the rolled portion as a reference rolling pressure on the rolling material, the solid line shows the relationship between tension and the width variation at Pr/Pro=1, that is, where the rolling pressure Pr under no tension is equal to the reference rolling pressure Pro, and the dotted chain shows the relationship when Pr/Pro<1. In the case of the reference rolling pressure with the set tension $T_{i,i-1}$, the width variation is at the point A on the solid line. When the temperature of the rolling material lowers, the rolling pressure is decreased and the width variation ΔB is shifted to the point B on the dotted chain, so that a width variation is caused. However, by increasing the tension by adding the tension correction values $\Delta T_{i,i-1}$ to the set value $T_{i,i-1}$, the width variation ΔB can be shifted to point C on the dotted chain, so that the change in the width can be prevented.

In this case, while the rolling pressure is changed due to the change in the tension, the variation in the rolling pressure is corrected by the no tension rolling pressure calculator 21, the calculated non-load rolling pressure Pr is kept constant so long as the deformation resistance remains unchanged, whereby accurate control is possible for the width dimension.

In the embodiment described above, explanation has been made with respect to a system in which the set tension correction value is input to the tension control device based on the rolling pressure under no tension, and the tension value. However, since this invention intends to correct the inter-stand tension based on the variation in the rolling pressure under no tension, the stand speed may be corrected directly. Such embodiments are shown in FIG. 12 and FIG. 13, respectively.

Figure 12:
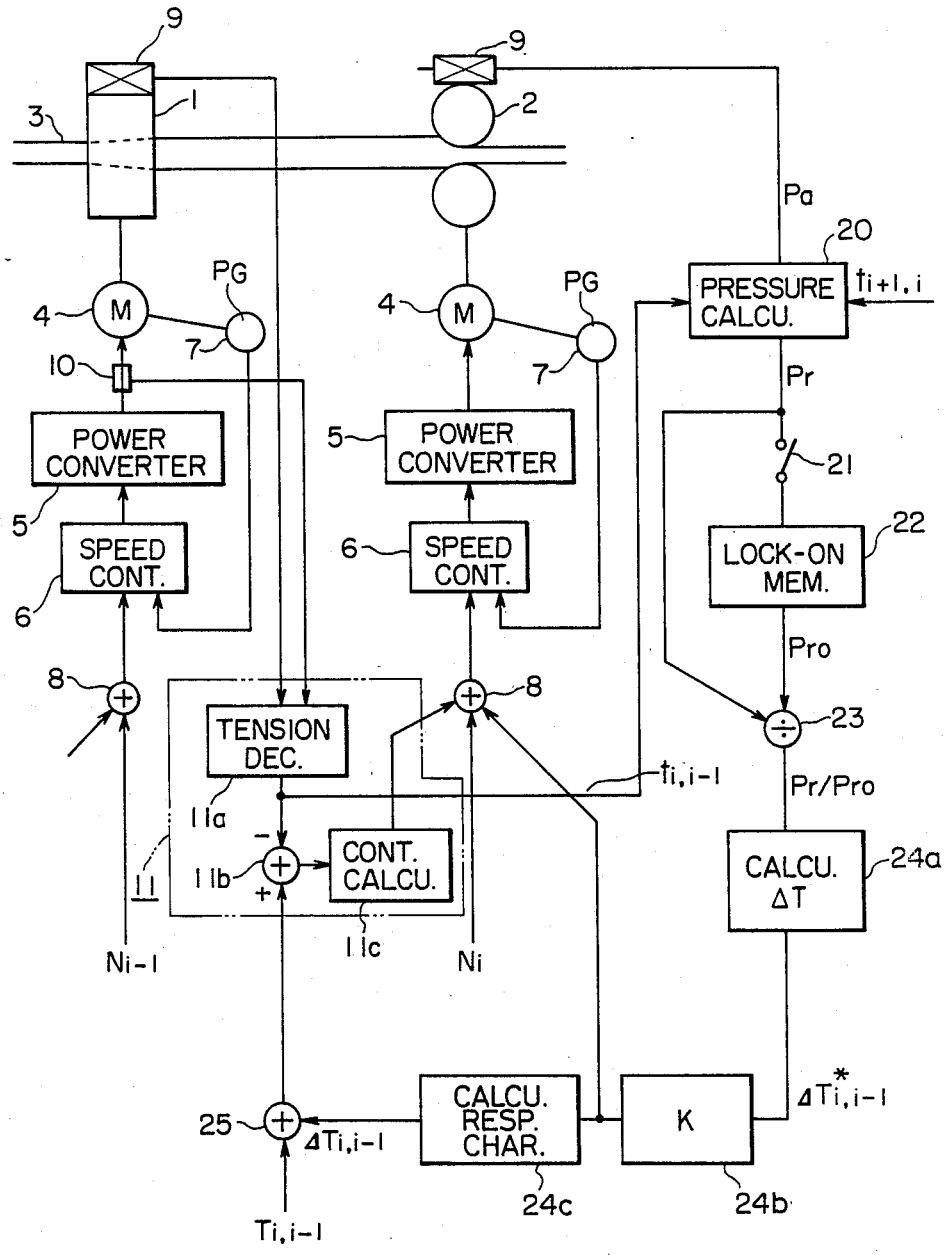
FIGS. 12 and 13 are block diagrams showing further embodiments of the present invention.

In the embodiment in FIG. 12, the rolling speed is directly corrected according to an inter-stand tension correction value, and the set tension value is corrected according to the response characteristic of the roll speed variation and the tension variation. In FIG. 12, reference numeral **24*a* represents a calculator for calculating an inter-stand tension correction value from a rolling pressure under no tension; 24*b*, a constant for converting an inter-stand tension correction value into a roll speed; and 24*c*, a calculator which is in correspondence with respect to the response correction value instruction. As the roll speed is changed by the output of the constant 24*b*, the tension in the rolling material is changed. If the set tension is unchanged, the tension is again made constant by the tension control calculator, and the calculator 24*c*** is provided in order to prevent this occurrance.

Figure 13:
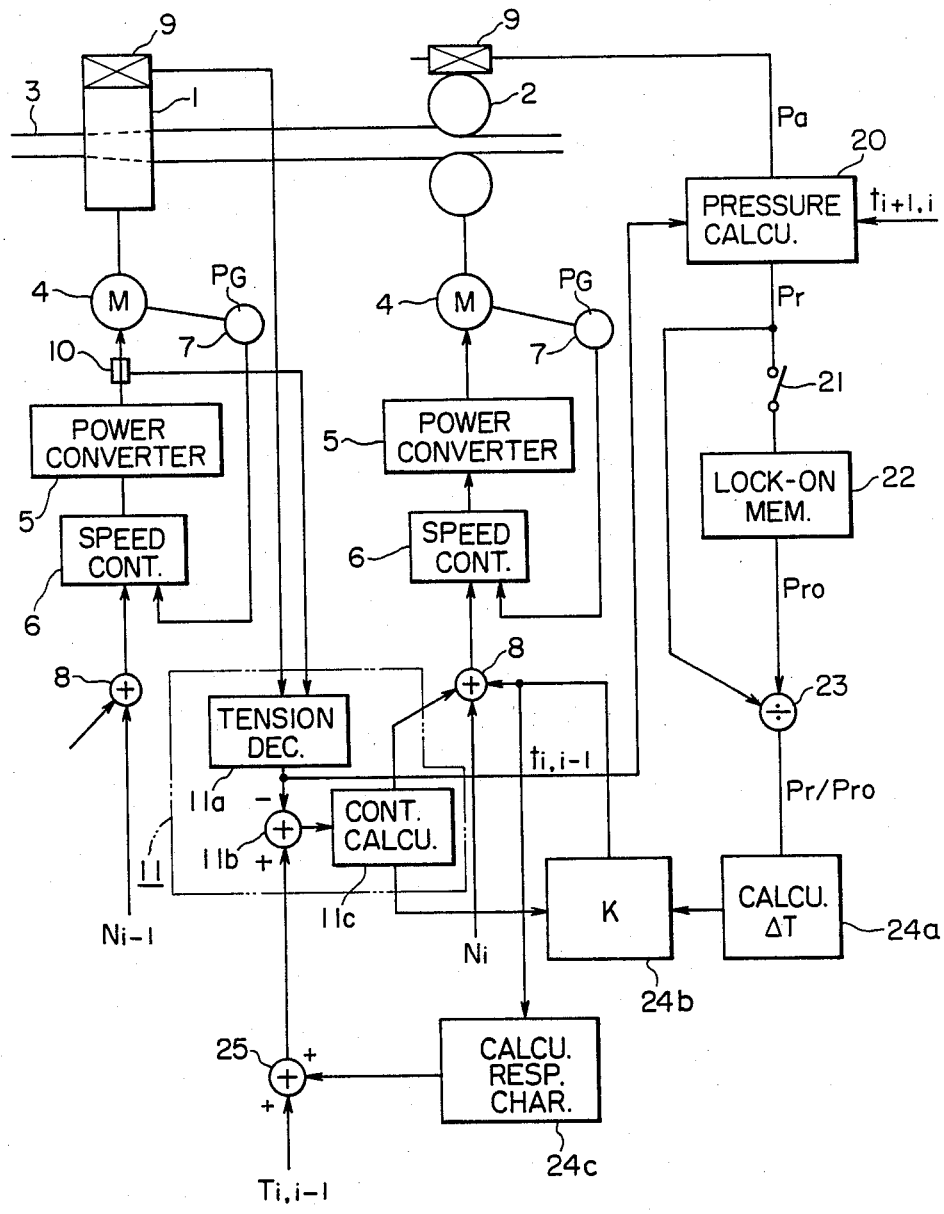

In the embodiment shown in FIG. 13, conversion of the inter-stand tension correction value into the roll speed correction value is carried out by the use of a tension roll speed gain as actually measured by the tension control calculator **11*c*, in addition to the function of the embodiment in FIG. 12**.

Although the embodiment described above show an example where the tension control device performs control according to the rolling pressure and the motor current, other types of tension control devices may also be used. Further, while an example correcting the speed of the downstream stand by the output of the tension control device has been shown, the speed of the upstream stand may be corrected.

In addition, while the reference value Pro of the rolling pressure under no tension is obtained from the measured value at the front end of the rolling material by the use of the lock-on switch 21 and the lock-on memory 22, the same effect can be had by obtaining the reference value Pro from a setter or the like.

As is apparent from the above description, according to the present invention, the tension set value of the continuous rolling machine is corrected according to the variation in temperature of the rolling material. Therefore, the width of the rolling material can be controlled to a constant at all times regardless of any temperature variation.

What is claimed is:

1. A dimension control device for controlling the width of rolling material to a constant value as it moves through a continuous rolling machine, comprising:

means for measuring tension in the rolling material between successive mill stands of said continuous rolling machine as a first rolling parameter, said tension affecting the width of the rolling material;

means for converting a temperature of the rolling material into a deformation resistance value;

means for measuring the deformation resistance value as a second rolling parameter proportional to changes in rolling material temperature;

means for correcting a set tension of the rolling material in said rolling machine in accordance with said second rolling parameter; and means for controlling the tension in the rolling material between said mill stands in accordance with said corrected set tension and said first rolling parameter so as to control the width of the rolling material to a constant value as said second rolling parameter changes with changes in rolling material temperature.

2. A dimension control device as set forth in claim 1, said tension controlling means correcting a roll speed in accordance with said first and second parameters, to correct the tension of the rolling material in accordance with the corrected roll speed.

3. A dimension control device as set forth in claim 2, further comprising means for calculating a roll speed correction gain in accordance with the tension set by said tension controlling means and the corrected roll speed.

4. A dimension control device for controlling the width of rolling material to a constant value as it moves through a continuous rolling machine, comprising:

means for measuring tension in the rolling material between successive mill stands of said continuous rolling machine as a first rolling parameter, said tension affecting the width of the rolling material;

means for measuring a second rolling parameter proportional to changes in rolling material temperature;

means for correcting a set tension of the rolling material in said rolling machine in accordance with said second rolling parameter;

means for controlling the tension in the rolling material between said mill stands in accordance with said corrected set tension and said first rolling parameter so as to control the width of the rolling material to a constant value as said second rolling parameter changes with change in rolling material temperature, said tension controlling means correcting a roll speed in accordance with said first and second parameters, to correct the tension of the rolling material in accordance with the corrected roll speed; and means for calculating a roll speed correction gain in accordance with the tension set by said tension controlling means and the corrected roll speed.

5. A dimension control device for controlling the width of rolling material to a constant value as it moves through a continuous rolling machine, comprising:

means for measuring tension in the rolling material between successive mill stands of said continuous rolling machine as a first rolling parameter, said tension affecting the width of the rolling material;

means for measuring a second rolling parameter proportional to changes in rolling material temperature;

means for correcting a set tension of the rolling material in said rolling machine in accordance with said second rolling parameter; and means for controlling the tension in the rolling material between said mill stands in accordance with said corrected set tension and said first rolling parameter so as to control the width of the rolling material to a constant value as said second rolling parameter changes with changes in rolling material temperature;

wherein said second rolling parameters comprises a rolling pressure at each of said mill stands as measured by said measuring means.

6. A dimension control device as set forth in claim 5, said tension controlling means correcting a roll speed in accordance with said first and second parameters, to correct the tension of the rolling material in accordance with the corrected roll speed.

7. A dimension control device as set forth in claim 6, further comprising means for calculating a roll speed correction gain in accordance with the tension set by said tension controlling means and the corrected roll speed.

8. A dimension control device for controlling the width of rolling material to a constant value as it moves through a continuous rolling machine comprising:

means for measuring the tension in rolling material between successive mill roll stands for the rolling machine, said measured tension being a first parameter affecting the width of the rolling material between the roll stands;

means for comparing the measured tension with a set tension to produce a first tension correction signal when the measured tension differs from the set tension;

means for measuring a second parameter proportional to changes in rolling material temperature; and means for altering the tension in the rolling material between adjacent roll stands in accordance with said second parameter so as to control the width of the rolling material to a constant value notwithstanding changes in rolling material temperature;

wherein said means for measuring said second parameter includes means for producing a first signal, Pr, proportional to the rolling pressure on the rolling material at a rolling stand with no tension applied, means for producing a second signal, Pro, proportional to the pressure on the rolling material with no tension applied when the front end of the rolling material has just locked onto said rolling stand, and means for producing a signal proportional to the ratio Pr/Pro to thereby produce a signal proportional to changes in deformation resistance resulting from temperature changes in said rolling material;

said means for altering the tension includes means, responsive to the signal proportional to the ratio Pr/Pro, for producing a set tension correction value signal.

9. The dimension control device as claimed in claim 8, wherein said means for altering the tension in the rolling material further includes; motor means for independently driving the rolls at the adjacent roll stations and speed control means for changing the relative speeds of the rolls at the adjacent roll stations, the relative speeds of the rolls controlling the tension of the rolling material between said adjacent roll stations, said speed control means being responsive to said first tension correction signal.

10. The dimension control device as claimed in claim 9, wherein said means for altering the tension further includes means for converting the set tension correction value signal into a speed control signal, and calculator means connected to an output of said speed control signal producing means for converting said speed control signal into another set tension correction value signal, an output of said speed control signal producing means being connected to said speed control means to directly apply said speed control signal to said speed control means, an output of said calculator means being connected to said means for changing the set tension to thereby apply said another set tension correction value to said means for changing the set tension.

11. The dimension control device as claimed in claim 10, wherein said means for altering the tension further includes means for connecting an output of said comparing means to an input of said converting means.

* * * * *